US007261652B2

(12) United States Patent
Gold

(10) Patent No.: US 7,261,652 B2
(45) Date of Patent: Aug. 28, 2007

(54) METHOD OF HOLDING A PUTTER AND PUTTING A GOLF BALL

(76) Inventor: Thomas Robert Gold, 6 Pembroke Rd., Weston, MA (US) 02493

( * ) Notice: Subject to any disclaimer, the term of this patent is extended or adjusted under 35 U.S.C. 154(b) by 48 days.

(21) Appl. No.: 10/768,939

(22) Filed: Jan. 30, 2004

(65) Prior Publication Data

US 2005/0170903 A1 Aug. 4, 2005

(51) Int. Cl.
*A63B 53/00* (2006.01)

(52) U.S. Cl. ..... 473/409; 473/294

(58) Field of Classification Search ..... 473/409, 473/294, 300, 282, 316
See application file for complete search history.

(56) References Cited

U.S. PATENT DOCUMENTS

| | | | | | |
|---|---|---|---|---|---|
| 4,303,244 | A * | 12/1981 | Uppvall | 473/409 |
| 4,605,228 | A | 8/1986 | Guendling, Jr. | |
| 5,520,392 | A * | 5/1996 | Foresi et al. | 473/227 |
| 5,616,089 | A | 4/1997 | Miller | |
| 5,785,608 | A * | 7/1998 | Collins | 473/313 |
| 5,830,081 | A * | 11/1998 | Kitahara | 473/294 |
| 5,830,082 | A * | 11/1998 | White | 473/294 |
| 5,855,524 | A * | 1/1999 | Jenkins | 473/409 |
| 5,913,738 | A * | 6/1999 | Carlucci | 473/409 |
| 5,976,025 | A * | 11/1999 | Williams | 473/252 |
| 6,068,562 | A * | 5/2000 | Hedges | 473/409 |
| 6,203,446 | B1 * | 3/2001 | Collins | 473/294 |
| 6,296,577 | B1 | 10/2001 | Trammell et al. | |
| 6,595,867 | B2 * | 7/2003 | Sosin | 473/290 |
| 6,743,115 | B2 * | 6/2004 | Rodarte | 473/294 |
| 2001/0002371 | A1 * | 5/2001 | Dionne | 473/293 |
| 2002/0025858 | A1 * | 2/2002 | Sosin | 473/340 |
| 2003/0157992 | A1 * | 8/2003 | Rodarte | 473/300 |
| 2004/0166956 | A1 * | 8/2004 | Shioda | 473/294 |
| 2005/0107181 | A1 * | 5/2005 | Shioda | 473/294 |

OTHER PUBLICATIONS

London Evening Standard, Jul. 25, 2003—Internet posting.
Rock Steady homepage—internet posting.

* cited by examiner

*Primary Examiner*—Raleigh W. Chiu
(74) *Attorney, Agent, or Firm*—Nields & Lemack

(57) ABSTRACT

Method of putting a golf ball using a putter having a club head of any legal configuration, and a shaft of sufficient length that its end can be held by the golfer against, or pressed into, the armpit or the area at the front of the shoulder, which area includes the pectoralis minor muscle (collectively "point of contact") on the target side of the player's body. The actual length of the shaft will be determined by the distance between the point of contact and the ground when the player has assumed a stance of his choosing. The target side arm is substantially fully extended, and the shaft rests against or is directly adjacent to that arm. The target side hand grasps the club with the target side arm at substantially full extension. The other hand can grasp the grip or the shaft, or rest on or grip the target side hand or arm, at any point and in any fashion.

25 Claims, 5 Drawing Sheets

FIGURE 3A
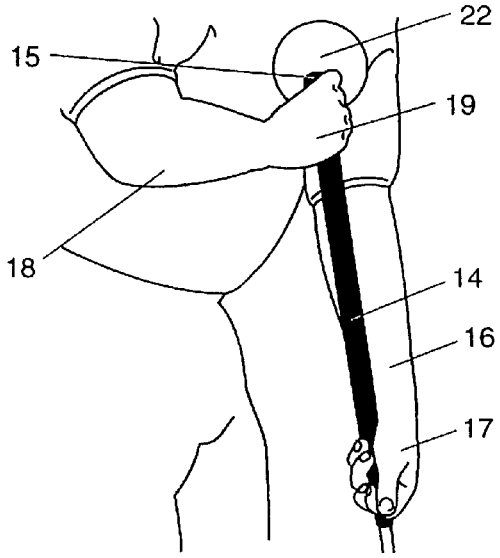
FIGURE 3B
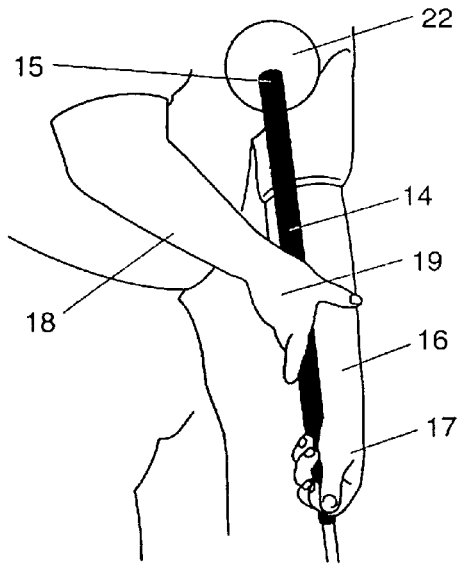
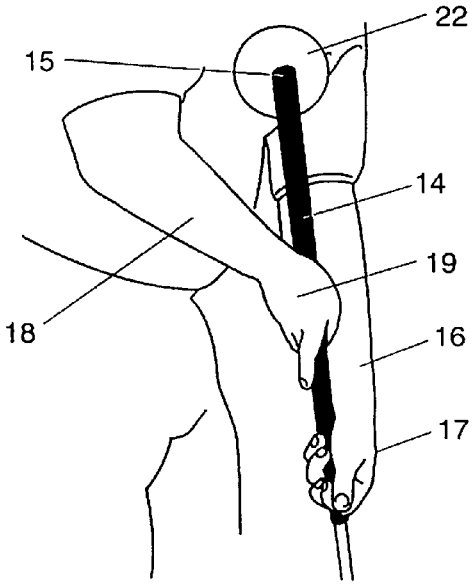
FIGURE 3C
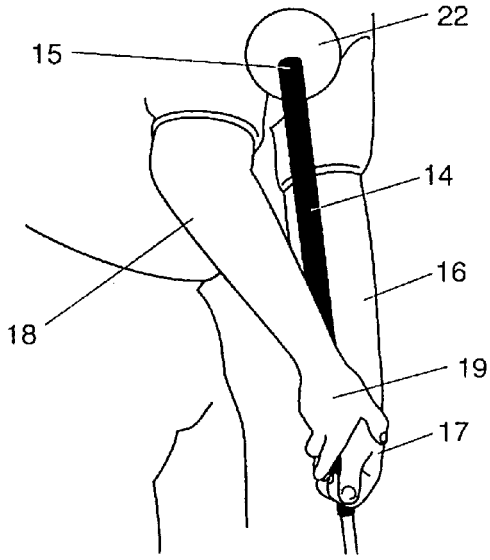
FIGURE 3D 15
16
14
17
10
12
23
24
24A
22
18
19
13
11

METHOD OF HOLDING A PUTTER AND PUTTING A GOLF BALL

FIELD OF INVENTION

The invention relates to a method of putting the golf ball, and, more particularly, to a method of puffing wherein a putter is pressed into or held against the armpit or the front of the shoulder on the target side of the body (the side of the body closest to the intended line of ball travel.)

BACKGROUND OF INVENTION

The game of golf has developed over the centuries, beginning in ancient Rome, continuing in Scotland, and finally evolving to its current form in the United States, Great Britain and the rest of the world.

The rules of golf, as principally propounded by the Royal and Ancient Golf Club of Saint Andrews and the United States Golf Association, call for a round of golf to be played over a course of 18 holes. Each golf hole begins with an area of closely mown grass, know as the tee, and ends at another area of closely mown grass, known as the green. In between the tee and the green are various areas, including the fairway, the rough, different forms of hazards (including sand and grass bunkers, water, etc.) and other generally indigenous terrain. Out of the green, a small circular hole (4¼ inches in diameter) is cut. This hole is known as the "cup". Golf holes range in length from approximately 100 yards to approximately 650 yards. 18 hole golf courses typically range in total length from 5,000 yards to 7,500 yards.

Golf is played using specially designed equipment, including clubs and balls, all of which must be configured per the rules of the relevant governing body. Clubs generally have a club head (used to strike the ball), an elongated, tapered, substantially tubular shaft to which the club head is attached, and a hollow substantially tubular piece made of rubber, leather or similar material, called the grip, which is placed over the shaft at its end opposite the club head.

The player stands astride of the ball, with feet apart and aligned substantially parallel to the desired line of ball travel. The player faces substantially perpendicular to the desired line of ball travel. The player holds the club with two hands on its grip. In the standard grip of a right handed golfer, the left hand is above the right, generally with the pinky finger of the right hand overlapping or interlocking with the index finger of the left. The player generally bends from the knees and waist, with slight crouching or arching of the back. The player swings the club (a stroke) in a motion which may involve action by the hands, wrists, arms, elbows, shoulders, torso, legs and feet, with the desired effect of striking the ball and propelling it forward, generally in the air, in the direction of the hole, in a straight line (or in a controlled and predictable arc.)

The player begins play of each hole at the tee, and hits as many strokes as are required to play the ball through to the green and into the hole. The object of the game is to play all 18 holes in the fewest number of strokes possible. The number of strokes in which a skilled player should complete each hole is referred to as "par" for that hole, and, when added together, the pars for all holes make up the par for the golf course. Par for a standard golf hole ranges from 3 to 5 strokes. Par for a regulation golf course is typically between 70 and 72 total strokes.

Each golf club is designed for a specific purpose, such as driving the ball off the tee, playing from the fairway or rough at various distances, recovering from hazards such as sand traps, and striking the ball on the green (called "putting"). The club used for putting is called a "putter".

Putting is unique, in that it is intended that the ball travel substantially on the ground toward the hole. In all other shots, the ball is meant to travel more-or-less in the air toward the hole.

The standard putting stance calls for the player to stand astride of the ball, or with the ball aligned opposite the player's foot nearest the hole, facing substantially perpendicular to the line of desired ball travel, feet aligned substantially parallel to the desired line of travel, knees slightly bent, with the back slightly crouched or arched, waist bent up to 90 degrees from erect. The standard putting grip in the right handed golfer calls for the left hand to be above the right on the putter grip, with the pinky finger of the right hand either overlapping or interlocking with the index finger of the left (as in the normal golf grip) or with the index finger of the left hand overlapping the ring and pinky finger of the right (called the reverse overlapping grip.)

It should be noted that with this standard grip, the right arm is more extended than the left, with the right hand and arm providing most of the motive force, and controlling, the putting stroke. This configuration can result in more error and less repeatability, because the side of the body controlling the stroke is the farthest from the intended path of travel and the target. The controlling side must therefore cross the body in its extension toward the target, with the body of the player potentially interfering with that extension.

One widely used variation of the putting grip, known as the "cross handed" grip, calls for the player's left hand to be placed below the right hand on the putter grip in the right handed putting stroke. The left arm is therefore more extended, and the left arm and hand provide the motive force, and control, the stroke. The possibility for variation and error is decreased as a result, because the controlling side does not have to cross the body in its extension toward the target.

Although the easiest stroke to learn initially, putting is the most precise and challenging aspect of golf to perform well. Since putting is directed at actually causing the ball to fall into the hole, it requires more precision than other golf strokes. Those other strokes are generally more concerned with distance and general direction of ball travel.

Further, because the ball is meant to travel on the ground, the golfer must take into account various elements relating to the terrain over which the player must putt to insure that his or her putt is accurate. These elements include the pitch of the ground over which the ball must travel (up, down and across) and factors relating to the grass itself (such as grain, length, grass type, and other surface conditions (such as surface moisture and foreign matter)). These elements all affect the direction and the force with which the player must strike the ball so that it will travel as desired. To putt well requires knowledge, finesse and experience to "read" the green (predict how the ball will roll), and to strike the ball in the direction and with the force that will cause it to end up falling into the hole, or, failing that, close enough to the hole so that it can be made to fall into the hole on the next stroke with relative ease.

In calculation of par for each hole, it is anticipated that a player will require two putts.

Putting is the most important element of the game to master, because one putting stroke counts equally with any other stroke played, even though the putt is played over a much shorter distance. A player can make up for many deficiencies in other elements of his or her game by putting well.

In order to putt the ball with precision, it is generally desirable for the golfer to have a putting stroke that is as repeatable and free of mechanical variation and error as possible. Achieving an error free, repeatable putting stroke is particularly difficult, given that the putting stroke is a highly refined motion performed principally with the fingers, hands, wrist, arms, elbows and shoulders. Particularly the wrists, hands and fingers have a multitude of bones, muscles, tendons, etc., which can serve as almost infinite sources for stroke variation or error. Even minor variation in the positioning and/or action in the stroke of any of these body elements can cause variations and/or errors which cause the putt to have a result other than that desired or intended by the golfer.

Much effort is devoted by the experienced golfer to perfecting a repeatable and error free putting stroke. Over time, one of the negative side effects of such effort is a syndrome known as the "yips". A player affected by the yips is unable to complete a normal putting stroke. The yips may cause the player to be unable to initiate the putting stroke at all, or to be unable to bring the club through the ball without substantial spasming of the hands, wrists and/or arms (even to the point that the ball is struck with excessive or inadequate force, often at an angle as much as 45–60 degrees or more off the desired target line.) The yips are particularly prevalent in affected players when putting at short distance (6 feet or less.) Yips often affect the controlling hand (e.g., the right hand in a right-handed golfer.)

For many years, it was felt that the yips were a purely psychological phenomenon. However, recent research indicates that the condition may in part be neurological in nature (a focal dystonia of some kind).

Many methods have been developed in an attempt to enhance repeatability and reduce the possibility of error in the putting stroke. See, e.g., Tramell et al, Method of Putting a Golf Ball, U.S. Pat. No. 6,296,577; Miller, Method of Putting, U.S. Pat. No. 5,616,089; and Guendling, Jr., Method of Putting a Golf Ball, U.S. Pat. No. 4,605,228. However, no method developed to date is as mechanically sound and eliminates the possibility for mechanical error and variation to the extent of the present invention. Also, the present invention provides for flexibility of posture and grip not present in some other methods disclosed to date. Also, because the putting stroke of the present invention involves two points of contact on the target side of the player's body, the left shoulder, arm, and hand control and provide most of the motive force in the putting stroke. The involvement of the non-target (normally controlling) side of the player's body is substantially incidental. Therefore, the method of putting of the present invention may be employed to avoid the yips by those so affected.

It should be noted that all of the foregoing descriptions of swing and grip apply equally to the left handed putting stroke, but the hand and body positions as described above are reversed.

SUMMARY OF INVENTION

The present invention is directed to a method of putting a golf ball using a putter having a club head of any legal configuration, and a shaft of sufficient length that its end can be held by the golfer against, or pressed into, the armpit or the area at the front of the shoulder, which area includes the pectoralis minor muscle (collectively "point of contact") on the target side of the player's body. The actual length of the shaft will be determined by the distance between the point of contact and the ground when the player has assumed a stance of his choosing. The target side arm is substantially fully extended, and the shaft rests against or is directly adjacent to that arm. The target side hand grasps the club with the target side arm at substantially full extension. The other hand can grasp the grip or the shaft, or rest on or grip the target side hand or arm, at any point and in any fashion.

By so gripping the putter, the target side arm of the player forms a fixed radius for the arc of the putting stroke and through which the putter will travel, eliminating or substantially reducing (a) any variable involvement of the fingers, wrists, lower arm and elbow and (b) any source of error that might arise from that variable involvement.

The player stands in a standard orientation astride the ball, or with the ball aligned opposite the player's target side foot, facing substantially perpendicular to the target line, and assumes a stance of his choosing. He swings the club in an arc in an orientation substantially parallel to the target line by (a) rotating his shoulders back and forth, (b) moving his target side arm back and forth by hinging it at the target side shoulder, and/or (c) in the downswing, pulling forward with the targets side arm and/or the back of the target side hand, striking the ball with the club head as he would in a normal putting stroke.

The present invention also discloses a method of gripping the club with the target side hand wherein the shaft enters at the top of the palm, travels substantially along the so-called life line of that hand, and exits between the index and third finger. This method of gripping the club causes the plane of the back of the target side hand to be substantially perpendicular to the target line, and allows the back of the target side hand to more easily pull straight along the target line. Such straight pulling of the back of the target side hand is more mechanically sound, and more likely to result in the club head travelling straight along the target line than other methods disciosed to date. As a result, the club head will more likely strike the ball squarely (with the club face at right angles to the intended target line), and the ball will more likely travel along the desired target line.

It should also be noted that though all references in this patent refer to putting, they can apply equally to the stroke known as "chipping", which is substantially similar to putting, but employed in areas off of, but proximate, to the putting green, and often employing clubs other than the putter.

BRIEF DESCRIPTION OF THE DRAWINGS

FIGS. 3A–3D are perspective views of various grips in accordance with various embodiments of the present invention;

NOMENCLATURE

Figure 1:
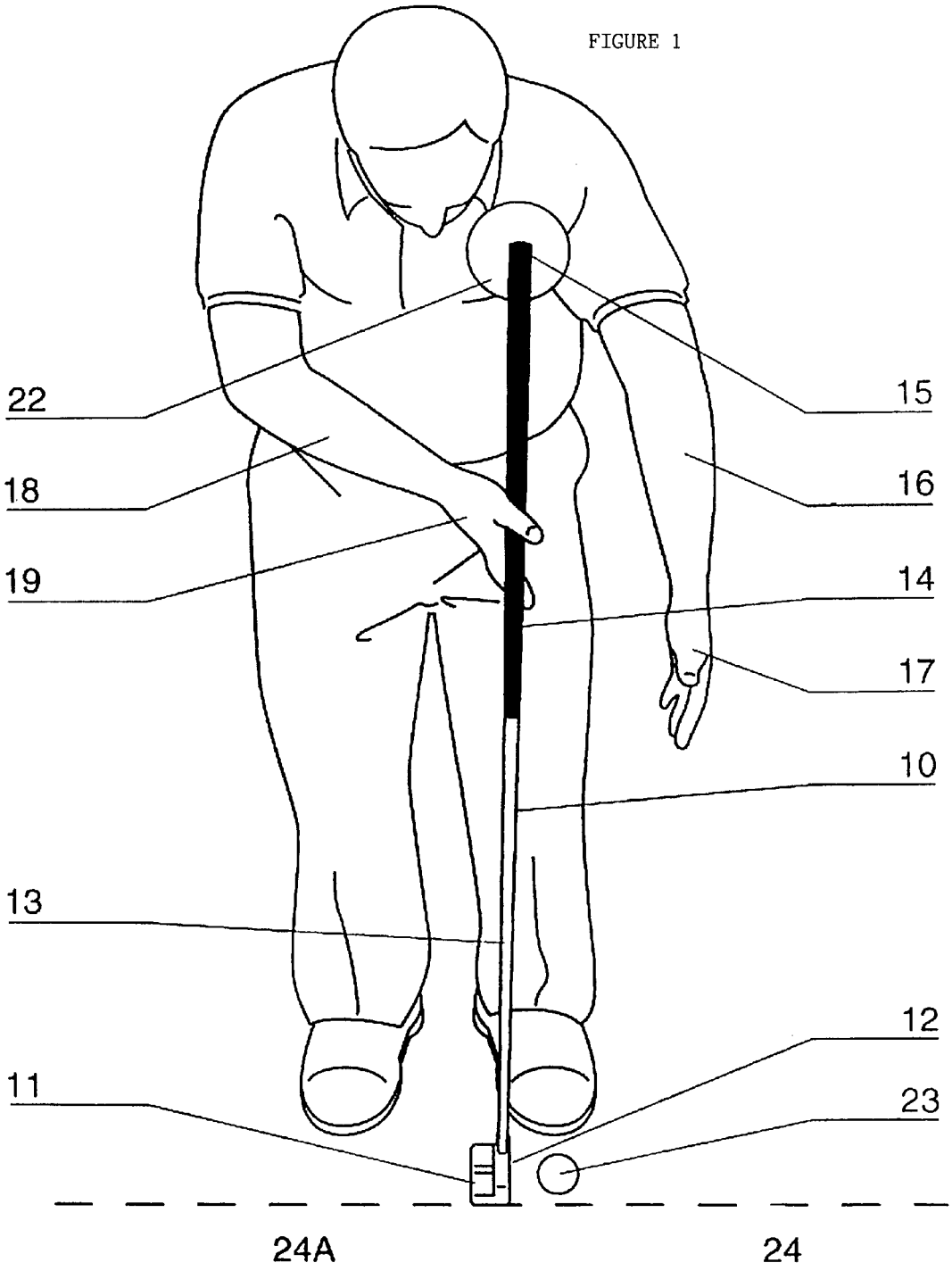
FIG. 1 is a front view showing a player astride a ball with the putter in place against the point of contact of the player.

10 Putter
11 Club head
12 Club face
13 Shaft
14 Grip

15 Shaft top
16 Target side arm
17 Target side hand
18 Other arm
19 Other hand
Target side armpit
Front of the target side shoulder (including pectoralis minor muscle)
22 Point of contact
23 Golf ball
24 Target line
24A Continuation of the target line

DETAILED DESCRIPTION OF THE INVENTION

The method of putting a golf ball 23 of the present invention is shown in the attached FIGS. 1 through 5. Although these figures and the following description refer to putting, those skilled in the art will appreciate that the same can apply to chipping.

As shown in FIG. 1, the putter 10 employed in the preferred embodiment has a shaft 13, to which is attached a club head 11, which club head 11 has a flat planar club face 12 mounted on the shaft 13 in a fashion such that, when the putter is held as intended, the club face 12 will be substantially perpendicular to the intended target line 24. The putter 10 also has a grip 14 which begins at a point on the shaft 13 and ends at the shaft top 15, which shaft top 15 is located at the end of the shaft 13 opposite the club head 11. The putter can be of any standard configuration and composition (which will be well known to any person well versed in the art of golf club manufacture), except that the shaft 13 is sized as indicated below. The shaft 13 is sized to enable a player to select a club head 11 and assume a stance of the player's choosing, to place the club head 11 on or immediately above the playing surface, and to place the shaft top 15 against, or press the shaft top 15 into, the player's target side armpit or the area at the front of the target side shoulder (which area includes the pectoralis minor muscle) (collectively the "point of contact" 22).

Figure 2:
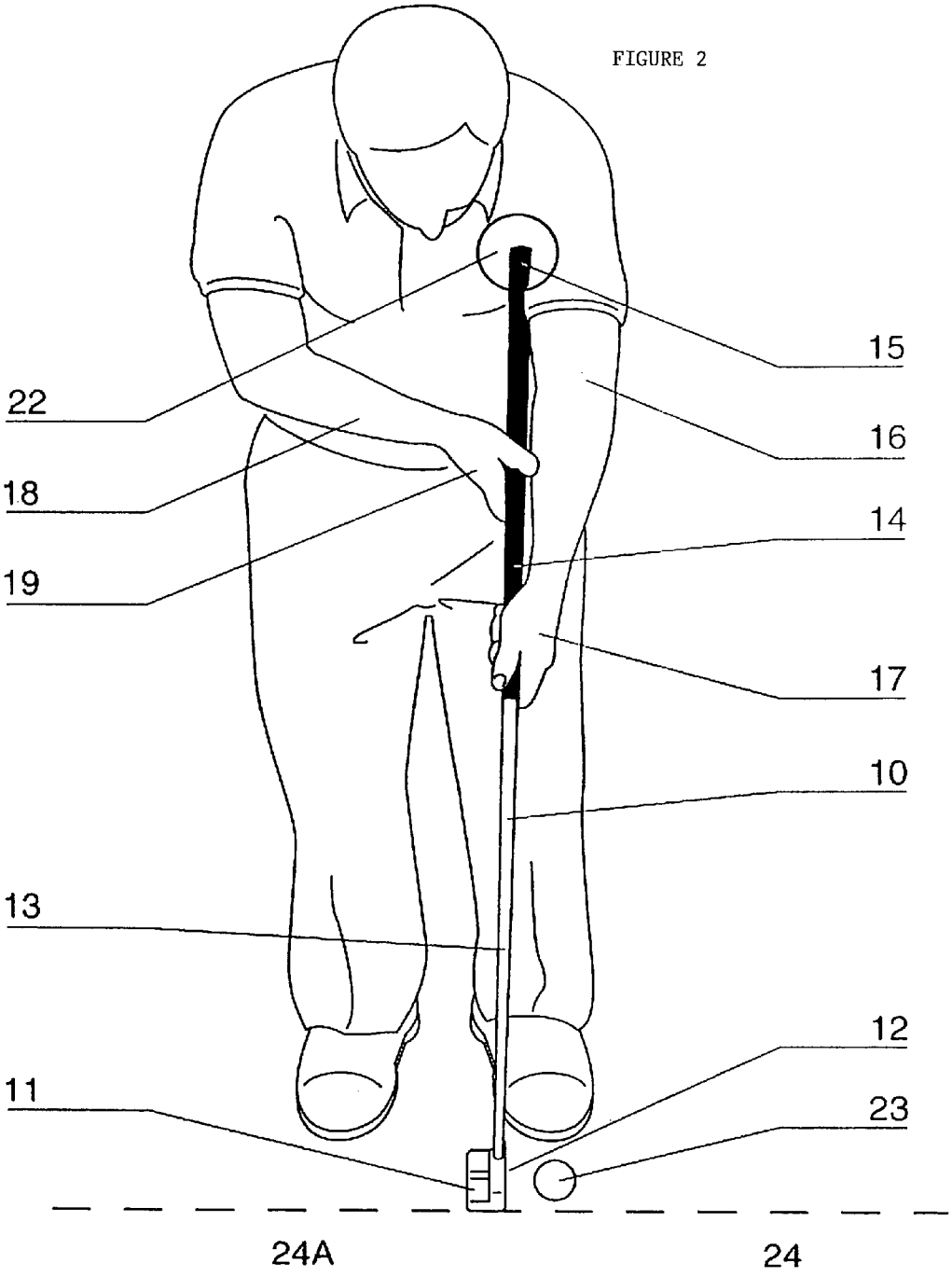
FIG. 2 is a front view of the player gripping the putter in accordance with an embodiment of the present invention.

As shown in FIG. 2, the player assumes any standard stance of his choosing, substantially astride the golf ball 23 (or with the golf ball aligned opposite the player's foot closest to the target), feet substantially perpendicular to the intended target line 24. The player rests the shaft top 15 against, or presses the shaft top 15 into, the point of contact 22. The level of pressure with which the shaft top 15 is held against or pressed into the point of contact 22 is at the player's discretion, provided that the shaft top 15 is not held or pressed so lightly that it can engage in substantial movement at the point of contact 22 during the swing, or so hard that it inhibits the player's ability to swing comfortably.

The player grasps the grip 14 with his target side hand 17 at substantially full extension. The target side arm 16 will thereby be resting along or immediately adjacent to the shaft 13. The other hand 19 grasps or rests upon the grip 14 or any point along the shaft 13 (including in a position such that it can rest on or grasp the target side hand 17 or target side arm 16) in any manner which is comfortable. The position of the other arm 18 will depend on where the other hand 19 grasps or rests. In the preferred embodiment, the other hand 19 is placed above the target side hand 17 on the grip 14. The preferred grip of the putter 10 by the other hand 19 is also illustrated in FIG. 3C.

Other methods for the other hand 19 to grip the putter 10, as described above, are illustrated in FIGS. 3A, 3B, and 3D.

In the preferred embodiment, the grip 14 is grasped by the target side hand 17 so that the shaft 13, as covered by the grip 14, enters at the top of the palm, and exits between the thumb and forefinger, as is standard. This grip is illustrated in FIG. 2 and in FIGS. 4A–D.

Alternatively, the present invention disloses a method whereby the shaft 13, as covered by the grip 14, enters the target side hand 17 at the top of the palm, travels down the so-called life line of the palm, and exits between the index finger and third finger of the target side hand 17 in a claw-like grip. The object of this grip configuration is to cause the plane of the back of the target side hand 17 to be substantially perpendicular to the target line 24, 50 that the target side hand 17 will more easily travel and/or pull straight along the target line 24. This alternative putting grip for the target side hand 17 can be used in conjunction with the method of puffing as described herein, but can also be used as part of any standard or cross handed putting grip. It is illustrated in detail in FIGS. 5A and 5B, and is also shown in FIGS. 3A–3D.

The grip employed with the other hand 19 is at the discretion of the player, as described above, with some possible grips illustrated in FIGS. 3A–3D. Thus, in FIG. 3A, the other hand 19 grasps the grip 14 in a fist-forming fashion, at or near the top of the grip 14, with the thumb and index finger above the other fingers of the other hand 19. In the embodiment of FIG. 3B, the other hand 19 grasps the grip 14 at a location above the target side hand 17, with the palm of the other hand 19 resting against the grip 14, and the fingers of the other hand 19 gripping the target side arm 16 as shown. The embodiment of FIG. 3C shows in greater detail the other hand 19 holding the grip 14 as in FIG. 2, between the thumb and the index finger. In the embodiment of FIG. 3D, the other hand 19 rests against the grip 14 in a manner similar to that of FIG. 3B, except that the other hand 19 is placed over the target side hand 17 as shown. Thus the thumb of the other hand 19 is wrapped over the target side hand 17 just above the target side hand's thumb, so that the target side hand's thumb extends between and below the other hand's thumb and index finger. The fingers of the other hand 19 grasp the fingers of the target side hand 17 as shown.

Figures 4A, 4B, 4C, 4D:
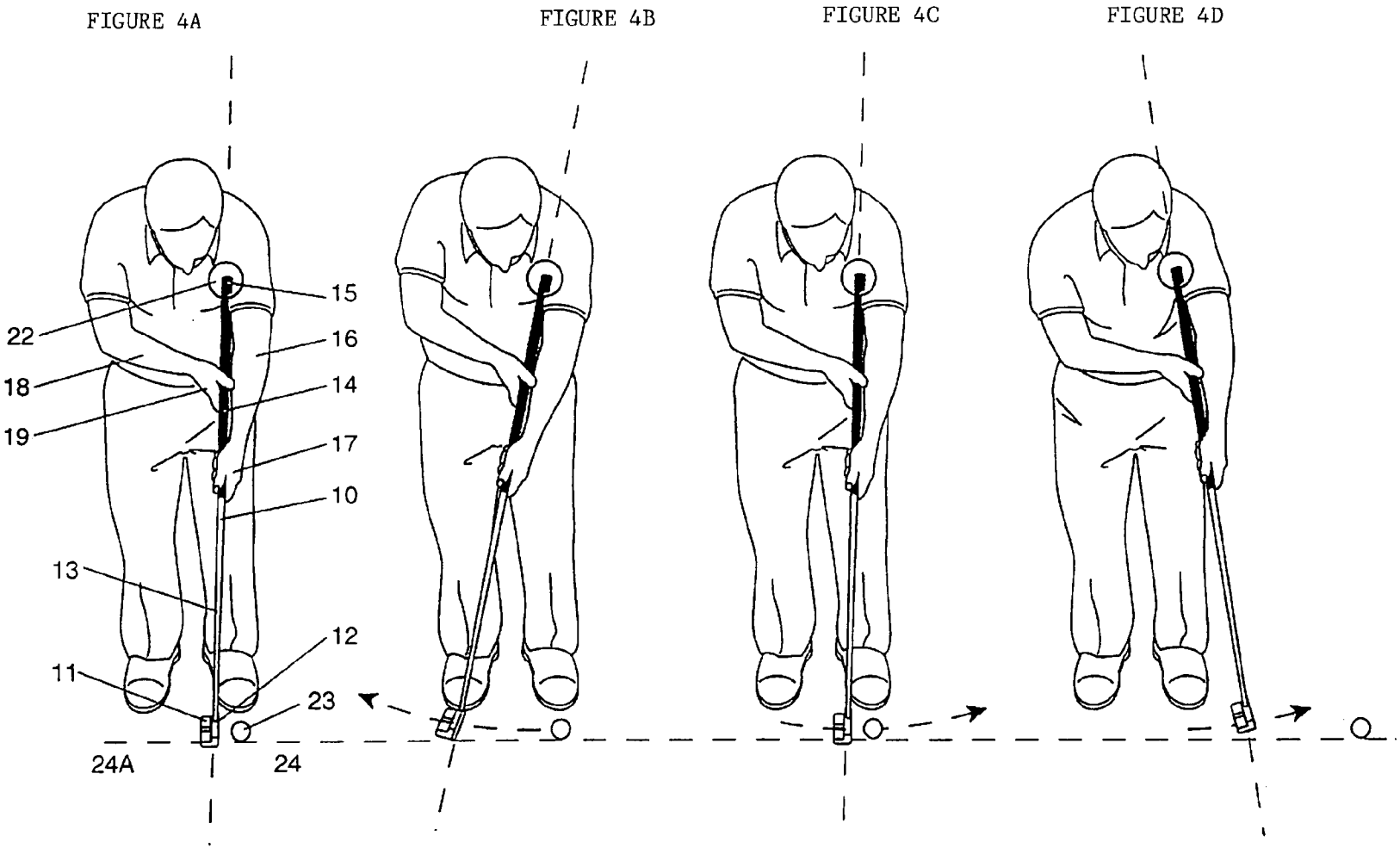
FIGS. 4A–4D are front views showing a putting stroke in accordance with an embodiment of the present invention.
Figure 5A:
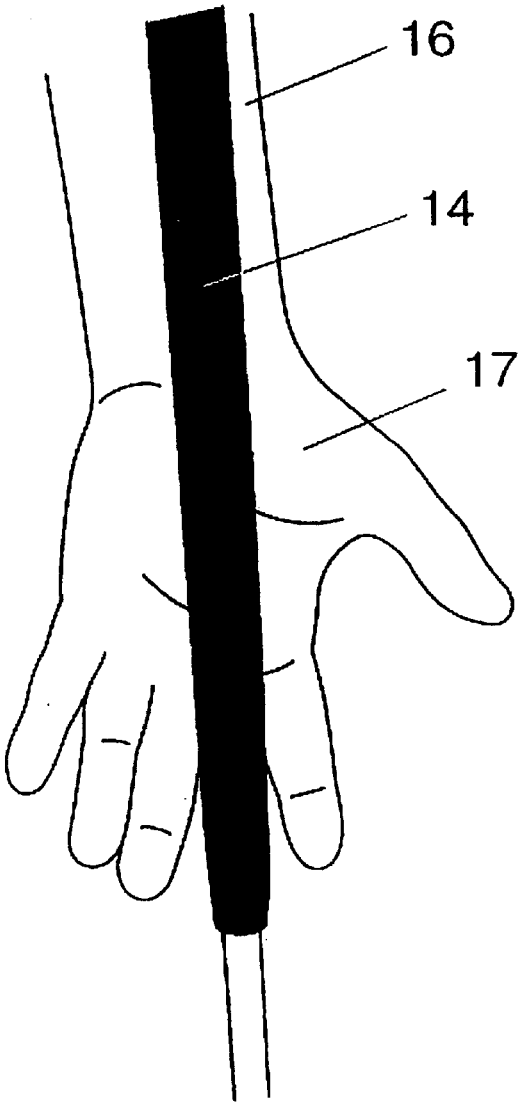
FIGS. 5A and 5B are views of a grip in accordance with one embodiment of the present invention.
Figure 5B:
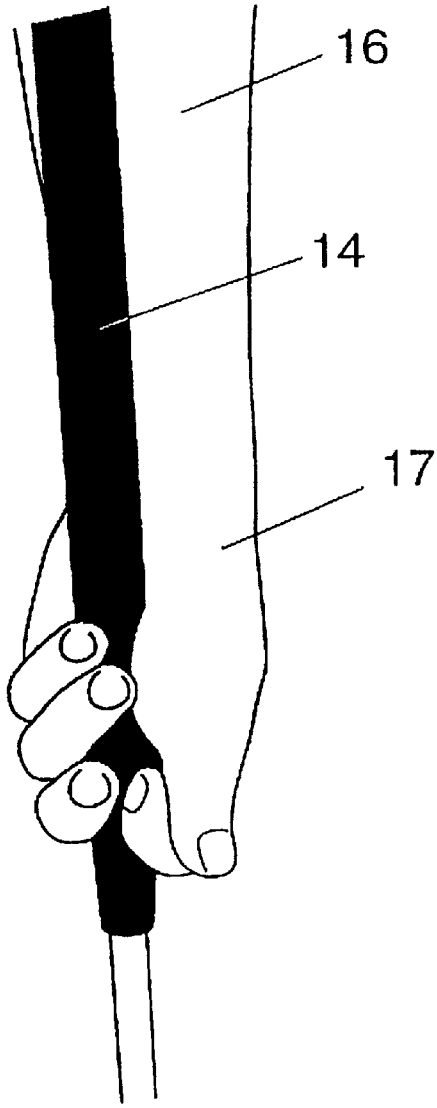

The complete putting stroke of the present invention is shown in FIGS. 4A through 4D. The putting stroke of the present invention will generally be comprised of the address position (illustrated by FIG. 4A), the take away (as illustrated by FIG. 4B), the down stroke, the completion of which results in ball contact (as illustrated by FIG. 4C) and the follow through (as illustrated by FIG. 4D). From address position (FIG. 4A), the player accomplishes the takeaway (FIG. 4B) generally utilizing shoulder rotation, pivoting of the target side arm 16 (from the shoulder on the target side) or a combination of the two to cause the club head 11 to travel away from the golf ball 23 substantially along a continuation of the target line 24A. After completing the take away (FIG. 4B), the player accomplishes the down stroke, ball contact and follow through (FIGS. 4C and 4D) utilizing shoulder rotation, pivoting of the target side arm 16 at the shoulder of the target side arm or pulling by the target side arm 16 and target side hand 17 (or combinations thereof) to cause the club head 11 to travel back along the continuation of the target line 24A, to contact the golf ball 23, and to continue along the target line 24 to the maximum extent possible. This stroke results in the golf ball 23 being propelled along the target line 24 in a controlled and anticipated manner. In the putting method of the present invention, the shaft 13 of the putter 10, as fixed in position by the grasp of the target side hand 17 and contact at the point of contact 22 by the shaft top 15, substantially reduces or eliminates any margin of error through variable involvement of the fingers, hands, wrists, lower arms or elbows.

This putting method provides the player with exceptional flexibility, control and consistent results in the putting of a golf ball. The player can either have a true pendulum motion (if solely shoulder rotation or solely target arm hinging are employed in making the stroke), or can use a combination of shoulder rotation, target arm hinging and target side arm and hand pulling to have a stroke which more closely resembles a standard one. This method is particularly helpful in creating a stroke in which the energy of the stroke is focused out toward the target, and in which desirable top spin is placed on the ball, causing it to better "track" along the target line.

This putting method can be used by either right handed or left handed players with equal results.

As mentioned above, it should also be noted that though all references in this patent refer to putting, they can apply equally to the stroke known as "chipping", which is substantially similar to putting, but employed in areas off of, but proximate, to the putting green, and often employing clubs other than the putter.

While the invention has been particularly shown and described with reference to a preferred embodiment thereof, it will be understood by those skilled in the art that various changes in form and details may be made therein without departing from the spirit and scope of the invention.

What is claimed is:

1. A method of a player holding a golf club with a target side hand and a second hand, such golf club having a shaft, a shaft top having an end face, a club head attached to said shaft, and at least one location on said shaft for gripping the club, said method comprising:

pressing said end face of said shaft top against the player's armpit or area at the front of shoulder of the arm of the target side hand;

with the target side hand, grasping one of said at least one location for gripping; and grasping with a second hand, or resting all or a portion of said second hand against, one of said at least one location for gripping.

2. The method of claim 1 wherein said target side hand grasps said golf club in a fashion such that said golf club enters said target side hand at the top of the palm and exits said target side hand between the thumb and forefinger of said target side hand.

3. The method of claim 1 wherein said target side hand grasps said golf club in a fashion such that said golf club enters said target side hand at the top of the palm and exits said target side hand between the index finger and third finger of said target side hand.

4. The method of claim 1, wherein said second hand grasps one of said at least one location for gripping between the forefinger and thumb of said second hand.

5. The method of claim 1, wherein said second hand grasps one of said at least one location for gripping by forming a fist about said location, wherein the thumb and index finger are above the other fingers.

6. The method of claim 1, wherein said second hand is placed on or against one of said at least one location for gripping, and said second hand and the fingers thereof overlap or grasp the forearm of the arm of said target side hand.

7. The method of claim 1, wherein said second hand is placed on or against one of said at least one location for gripping, and said second hand and the fingers thereof overlap or grasp said target side hand.

8. The method of claim 1, wherein said golf club is used for putting.

9. The method of claim 1, wherein said golf club is used for chipping.

10. The method of claim 1, wherein the target side arm is substantially fully extended and parallel to said shaft.

11. A method of a player striking a golf ball with a golf club held by a target side hand and a second hand, said golf club having a shaft, a shaft top having an end face, a club head attached to said shaft, and at least one location for gripping said golf club on said shaft, said method comprising:

pressing said end face of said shaft top against the armpit or front of the shoulder of the arm of said player's target side hand;

grasping one of said at least one location for gripping with said target side hand;

grasping with said second hand, or resting said second hand on, one of said at least one location for gripping;

causing said club to move away from said golf ball positioned adjacent said player's feet while maintaining contact between said shaft top and said armpit or front of the shoulder of the arm of said target side hand;

causing said golf club to move in a direction towards said golf ball while maintaining contact between said shaft top and said armpit or front of the shoulder of the arm of the target side hand, to cause said club head to strike said golf ball.

12. The method of claim 11 wherein said target side hand grasps said golf club in a fashion such that said golf club enters said target side hand at the top of the palm and exits said target side hand between the thumb and forefinger of said target side hand.

13. The method of claim 11 wherein said target side hand grasps said golf club in a fashion such that said golf club enters said target side hand at the top of the palm and exits said target side hand between the index finger and third finger of said target side hand.

14. The method of claim 11, wherein said second hand grasps one of said at least one location for gripping between the forefinger and thumb of said second hand.

15. The method of claim 11, wherein said second hand grasps one of said at least one location for gripping by forming a fist about said location, wherein the thumb and index finger are above the other fingers.

16. The method of claim 11, wherein said second hand is placed on one of said at least one location for gripping, and said second hand and the fingers thereof overlap or grasp the forearm of the arm of said target side hand.

17. The method of claim 11, wherein said second hand is placed on one of said at least one location for gripping, and said second hand and the fingers thereof overlap or grasp said target side hand.

18. The method of claim 11, wherein said golf club is used for putting.

19. The method of claim 11, wherein said golf club is used for chipping.

20. The method of claim 11, further comprising continuing said movement of said club head in a direction towards said golf ball so that said club head travels beyond the location that said golf ball was positioned prior to said club head striking said golf ball.

21. The method of claim 11, wherein said club head is caused to move away from said golf ball, to move toward said golf ball and to strike said golf ball through rotation of the shoulders.

22. The method of claim 11, wherein said club head is caused to move away from said golf ball, to move toward said golf ball and to strike said golf ball through pivoting of the arm of the target side hand at the shoulder.

23. The method of claim 11, wherein said club head is caused to move toward and to strike said golf ball through pulling by said target side hand and/or the arm of said target side hand in whole or in part.

24. The method of claim 11 wherein said club head is caused to move away from said golf ball, to move toward said golf ball and to strike said golf ball through a combination of rotation of the shoulders, pivoting of the arm of said target side hand at the shoulder, and/or pulling by said target side hand and/or the arm of said target side hand.

25. The method of claim 11, wherein the target side arm is substantially fully extended and parallel to said shaft.

* * * * *